US005593572A

United States Patent [19]

Hart

[11] Patent Number: 5,593,572

[45] Date of Patent: Jan. 14, 1997

[54] SETTLING AIDS FOR SOLIDS IN HYDROCARBONS

[75] Inventor: Paul R. Hart, The Woodlands, Tex.

[73] Assignee: BetzDearborn Inc., Trevose, Pa.

[21] Appl. No.: 286,024

[22] Filed: Aug. 4, 1994

[51] Int. Cl.[6] ..... C10G 21/27

[52] U.S. Cl. ..... 208/177; 210/732

[58] Field of Search ..... 208/180, 177; 252/320, 325; 210/732

[56] References Cited

U.S. PATENT DOCUMENTS

| | | | |
|---|---|---|---|
| 2,264,756 | 12/1941 | Johnston, Jr. | 252/320 |
| 3,020,229 | 2/1962 | Thompson et al. | 210/732 |
| 3,020,230 | 2/1962 | Smith | 210/732 |
| 4,252,646 | 2/1981 | Carretd | 210/732 |
| 4,252,647 | 2/1981 | Carretd | 210/732 |
| 4,336,129 | 6/1982 | Yoshimura et al. | 208/180 |
| 4,383,927 | 5/1983 | Srivastd | 210/732 |
| 4,431,548 | 2/1984 | Lipowski et al. | 210/732 |
| 4,539,099 | 9/1985 | Merchant et al. | 210/732 |
| 4,943,378 | 7/1990 | Flesherett | 210/732 |
| 5,006,639 | 4/1991 | Tono et al. | 210/732 |
| 5,372,727 | 12/1994 | Koester et al. | 210/732 |

FOREIGN PATENT DOCUMENTS

| | | |
|---|---|---|
| 1725957 | 4/1992 | U.S.S.R. . |

*Primary Examiner*—Helane Myers

*Attorney, Agent, or Firm*—Alexander D. Ricci; Philip H. Von Neida

[57] ABSTRACT

A method for accelerating the settling of finely divided solids in hydrocarbon fluids comprising adding to the hydrocarbon a sufficient settling amount of a hetero-atom punctuated fatty polymer. Preferably, the hydrocarbon is a fluid catalytic cracker slurry containing spent catalyst fines.

10 Claims, No Drawings

SETTLING AIDS FOR SOLIDS IN HYDROCARBONS

FIELD OF THE INVENTION

The present invention relates to methods for accelerating settling of solids in hydrocarbon fluids. The methods of the present invention are particularly efficacious at accelerating the settling of FCC catalyst fines in an oil slurry.

BACKGROUND OF THE INVENTION

Unrefined hydrocarbons such as crude oil, resids and bottom streams often contain finely divided solid matter which often must be removed prior to further use or processing. These solids can include solids of a soil-like nature, finely divided silicas, clays, silt and coke, and metal oxide and sulfide corrosion solids. These solids may include traces of metal particles such as lead, nickel, chromium and the like, and salts thereof.

For instance, fluid catalytic cracker (FCC) units use a fluidized bed of zeolite type aluminosilicate clay particles to crack heavy petroleum fractions into lighter fractions at elevated temperatures. The catalyst is eventually deactivated by poisoning or coking. These spent fines must be removed from the FCC on a continual basis so that slurry containing fresh catalyst can be added.

Some of this slurry oil containing the spent fines is then typically settled in tankage, though hydrocyclones are sometimes used to accelerate the separation process. Both native and synthetic components of the slurry oil have a dispersant effect which retards the settling of the fines.

The present inventor has discovered that certain chemical agents, when added to the slurry oil, have an anti-dispersant or coagulent effect which accelerates the settling process. This produces a cleaner decant oil (typically <0.05 wt % ash) in a shorter period of time and can then be sold as carbon black feedstock or residual fuel oil.

DETAILED DESCRIPTION OF THE INVENTION

The present invention relates to methods for accelerating the settling of finely divided solids in hydrocarbon fluids comprising adding a hetero-atom punctuated fatty polymer. More particularly, the present invention provides methods for accelerating the settling of spent fluid catalytic cracker (FCC) catalyst fines in an oil slurry comprising adding to the slurry a hetero-atom punctuated fatty polymer.

By "hetero-atom punctuated fatty polymers" it is meant a polymer of MW $10^3$ to $10^6$ in which $C_{10}$–$C_{30}$ alkyl or alkenyl "fatty" hydrocarbon groups are separated in some way ("punctuated") by hetero-atom (non-C,H) containing groups such as ethers, esters, amides, amines, phenols, heterocycles, thio and halo carbons, and the like, which are smaller in size than the fatty groups.

The particular hetero-atom punctuated fatty polymers useful in the present invention will be effective at accelerating settling of finely divided solids, particularly FCC catalyst fines. These polymers include but are not limited to ethylene-vinylacetate (EVA) copolymers, dialkylfumerate-vinylacetate copolymers (DAFVA), alkylphenol-formaldehyde resins, poly(alkylacrylates) and blends of these polymers.

The hetero-atom punctuated fatty polymers prove effective in a variety of hydrocarbon fluids. These hydrocarbon fluids are generally unrefined hydrocarbons that are prone to containing finely divided solids. These hydrocarbon fluids include but are not limited to crude oils, resids, bottom streams, vacuum bottoms, heavy ends, and the like.

Actual dosage ranges for the hetero-atom punctuated fatty polymers depend upon the characteristics of the hydrocarbon to be treated. These characteristics can vary and include the type of hydrocarbon, the type and amount of finely divided solid present, and the presence of other impurities and surfactants in the hydrocarbon. Preferably, about 10 parts to about 1000 parts of the hetero-atom punctuated fatty polymers per million parts of the hydrocarbon. Different hydrocarbons will surely have different optimum dosage ranges.

The hetero-atom punctuated fatty polymers can be fed to the hydrocarbon to be treated neat or in a suitable solvent that is compatible with the treatment and the hydrocarbon. Examples of such solvents include but are not limited to linear or branched chain aliphatic and aromatic solvents such as naphtha, toluene, xylene and the like.

The polymers of the present invention can be used in conjunction with other hydrocarbon treatment chemicals particularly flocculants which can be inorganic or organic and include any material that enhances aggregation of finely dissolved solids to form a floc and enhance settling of solids and phase separation or transfer, and demulsifiers, which can be any material that accelerates the settling of water with which the solids can be associated.

The following examples are intended to show the efficacy of the present invention as an accelerator for settling finely divided solids in hydrocarbons and should not be construed as limiting the scope of the invention.

EXAMPLES

Catalyst Settling Aid Test.

This test measures the fraction of FCC catalyst fines which settle to the bottom of a slurry sample compared to the amount which remains dispersed on top. This test simulates slurry settling in tankage between ambient temperature and 200° F.

Experimental

Collect 100 mL of FCCU slurry in 6 oz. bottles. Place bottles in a water bath and heat to process temperature. Remove each bottle from the bath and add the appropriate treatment to the desired bottles. Place the bottles in an insulated shaker and shake on high speed setting for 10 minutes. Return the bottles to the bath and allow to stand undisturbed for the predetermined settling period. This predetermined settling time for a blank is determined by analyzing several untreated bottles according to this test procedure at various time intervals centered on the tank's residence time (e.g., 5 hours, 1 day, 3 days, 7 days).

For most samples, the 50% method described below is used. For extremely fast settling samples, a short settling time and the 95% method described below is used. For very slow settling samples, a long settling time and the 20% or 10% variation of the 50% method is used.

50% method (or 20% or 10%)

Piper off the top 50 mLs (top sample) with a syringe being careful not to disturb the sample or insert the needle below the 50 (or 80 or 90) mL line, and transfer to a clean bottle. The original bottle contains the bottom sample.

95% method

Pour off ~95 mLs into a clean bottle (top sample). The remaining ~5 mLs in the original bottle is the bottom sample.

Place filter pads in small petri dishes, dry uncovered at 220° F. for one hour, remove from oven and allow to cool in a desiccator. Weigh and record filter weight.

Place filter in a paraoloid filtration funnel and wet with xylene or toluene to ensure a good seal for vacuum filtration. Shake the oil sample vigorously and carefully pour it up to 50 mL at a time into a graduated centrifuge tube, then double the volume, up to 100 mL, with xylene or toluene.

Heat the centrifuge tube to 180° F. in a water bath. Centrifuge for 15 minutes. Turn on the vacuum pump and pour a small amount of hot oil from the centrifuge tube into the filter funnel and allow it to filter. Rinse with xylene or toluene. Continue adding small amounts and rinsing until all the sample has been filtered. Then rinse centrifuge tube and funnel with more xylene or toluene until it is clean. Remove filter bowl and wash, under vacuum, the filter pad with xylene or toluene followed by petroleum ether or heptane. Dry filter pad in an oven at 220° F. for one hour. Allow to cool in a desiccator and reweigh.

Place the filters in glass petri dishes and ash in a muffle furnace at ~900° F. Weigh again to determine catalyst weights, being careful not to disturb loose ash on filters.

The % settled is calculated by the following methods:

$$\%\ \text{settled} = \frac{\text{bottom} - \text{top (g)}}{\text{bottom} + \text{top (g)}} \qquad \text{50\% Method}$$

$$\%\ \text{settled} = \frac{\text{bottom} - 4 \times \text{top (g)}}{\text{bottom} + \text{top (g)}} \qquad \text{20\% Method}$$

$$\%\ \text{settled} = \frac{\text{bottom} - (5/95) \times \text{top (g)}}{\text{bottom} + \text{top (g)}} \qquad \text{95\% Method}$$

A settling period which yields about 40 to 50% settled should be chosen. Repeat the optimal procedure determined from the blanks after adding chemical treatments at the process dosage.

Testing was performed utilizing the compounds of the instant invention and commercially available nonylphenol-formaldehyde resin ethoxylates, a chemical type believed to be used as an FCC catalyst settling aid.

TABLE I

Various refineries
Slurry settling study
75 ppm active treatment added

| | % Ash Settled | | | | | |
|---|---|---|---|---|---|---|
| Treatment | Southern Refinery Settled 14 days @ 170° F. 50% Method | Northeast Refinery Settled 6 days @ 170° F. 50% Method | | Western Refinery Settled 14 days @ 70° F. 95% Method | | |
| A | 25 | 84.9 | 82.9 | 94.6 | 93.6 | 85.3 |
| B | 18 | 85.6 | — | 94.6 | — | — |
| C | 28 | 78.3 | — | 90.4 | — | — |
| Comp 1 | −17* | 65.0 | 70.2 | 97.8 | 93.1 | 84.8 |
| Blank | 21 | 71.7 | 58.3 | 91.8 | 87.8 | 75.3 |

*negative numbers can result from an air flotation effect.
Treatment A is a 2:1 (actives) blend of $C_{17}$ poly(ethylene)-vinylacetate $10^5$ MW copolymer and di-$C_{22}$-alkylfumerate-vinylacetate $3 \times 10^4$ 2:1 copolymer.
Treatment B is a $C_{24}$ alkylphenol-formaldehyde resin.
Treatment C is a $C_{10}$ poly(ethylene)-vinylacetate $10^4$ MW copolymer.
Comp 1 is a commercially available nonylphenol-formaldehyde ethoxylate.

These results indicate that the compounds of the instant invention both individually and in combination provide effective settling in fluids from different refineries.

Further testing was performed on an FCCU catalyst slurry and is reported in Table II.

TABLE II

Southern Refinery
FCCU catalyst slurry settling study
1 day settling time at 160° F.
50 and 95% methods

| Treatment | 130–140 total volume weight ash in mg | | | % Settled from top 50% to | % Settled from top 96% to |
|---|---|---|---|---|---|
| (ppm) | 70 mL (top) | 55–65 (mid) | 5 mL (bot) | Bottom 50% | Bottom 4% |
| A (45) | 45.5 | 36.4 | 74.3 | 42 | 45 |
| A (45) | 46.4 | 30.3 | 69.8 | 37 | 45 |
| Comp 1 | 47.9 | 38.8 | 151.8* | 60* | 62 |
| (75) | 45.8 | 25.1 | 69.6 | 35 | 47 |
| Blank (0) | 47.5 | 37.2 | 87.0 | 45 | 49 |
| | 45.5 | 36.8 | 85.0 | 46 | 49 |

TABLE II-continued

Southern Refinery
FCCU catalyst slurry settling study
1 day settling time at 160° F.
50 and 95% methods

| Treatment | 130–140 total volume weight ash in mg | | | % Settled from top 50% to | % Settled from top 96% to |
|---|---|---|---|---|---|
| (ppm) | 70 mL (top) | 55–65 (mid) | 5 mL (bot) | Bottom 50% | Bottom 4% |

*Probable chunk in bottle which fell to the bottom.
Treatment A is a 2:1 (actives) blend of $C_{17}$ poly(ethylene)-vinylacetate $10^5$ MW copolymer and di-$C_{22}$-alkylfumerate-vinylacetate $3 \times 10^4$ MW 2:1 copolymer.
Comp 1 is a commercially available nonylphenol-formaldehyde ethoxylate.

As seen in Table III, the hetero-atom punctuated fatty polymers of this invention proved more effective and more efficient at settling the slurry than commercially available compounds.

Midwestern refinery
Slurry settling study
24 hours settling time at 200° F.
95% method

| Treatment (ppm) | Filterable Solids Total wt (g) | Top 95% wt (g) | Top 95% wt (% solids) | Bot 5% wt (g) | Bot 5% wt (% solids) | % Settled (B-5T/95)/(B + T) |
|---|---|---|---|---|---|---|
| Blank | 0.2410 | 0.1868 | 77.50 | 0.0542 | 22.5 | 18 |
| A (15) | 0.3277 | 0.2106 | 64.30 | 0.1171 | 35.70 | 32 |
| Comp 1 (30) | 0.2550 | 0.2007 | 78.70 | 0.0543 | 21.30 | 17 |
| Comp 2 (30) | 0.2277 | 0.1758 | 77.20 | 0.0519 | 22.80 | 19 |

TABLE IV

Midwest refinery
Slurry settling study
24 hours settling time at 200° F.
95% method

| Treatment (ppm) | Ash Total wt (g) | Top 95% wt (g) | Top 95% wt (% solids) | Bot 5% wt (g) | Bot 5% wt (% solids) | % Settled (B-5T/95)/(B + T) |
|---|---|---|---|---|---|---|
| Blank | 0.2269 | 0.1780 | 78.40 | 0.0489 | 21.60 | 17 |
| A (15) | 0.3071 | 0.2004 | 65.30 | 0.1067 | 34.70 | 31 |
| Comp 1 (30) | 0.2397 | 0.1904 | 79.40 | 0.0493 | 20.60 | 16 |
| Comp 2 (30) | 0.2139 | 0.1671 | 78.10 | 0.0468 | 21.90 | 18 |

Treatment A is a 2:1 (actives) blend of $C_{17}$ poly(ethylene)-vinylacetate copolymer $10^5$ MW and di-$C_{22}$-alkylfumerate-vinylacetate $3 \times 10^4$ 2:1 copolymer.
Comp 1 is a commercially available nonylphenol-formaldehyde ethoxylate.
Comp 2 is a commercially available nonylphenol-formaldehyde ethoxylate.

As seen in Tables III and IV, a combination of polymers of the present invention provided good settling of both filterable solids and ash. These polymers also performed better than the commercially available compound settling filterable solids and ash.

TABLE V

Midwestern refinery
Slurry settling study
24 hours settling time at 200° F.
95% method

| Treatment (ppm) | Filterable Solids Total wt (g) | Top 95% wt (g) | Top 95% wt (% solids) | Bot 5% wt (g) | Bot 5% wt (% solids) | % Settled (B-5T/95)/(B + T) |
|---|---|---|---|---|---|---|
| Blank | 0.2021 | 0.1654 | 81.80 | 0.0367 | 18.20 | 14 |
| A (37.5) | 0.2120 | 0.1739 | 82.00 | 0.0381 | 18.00 | 14 |
| Comp 1 (75) | 0.2038 | 0.1520 | 74.60 | 0.0518 | 25.40 | 21 |
| Comp 2 (75) | 0.2093 | 0.1165 | 55.70 | 0.0928 | 44.30 | 41 |

TABLE VI

Midwestern refinery
Slurry settling study
24 hours settling time at 200° F.
95% method - ash

| Treatment (ppm) | Ash Total wt (g) | Top 95% wt (g) | Top 95% wt (% solids) | Bot 5% wt (g) | Bot 5% wt (% solids) | % Settled (B-5T/95)/(B + T) |
|---|---|---|---|---|---|---|
| Blank | 0.1896 | 0.1569 | 82.80 | 0.0327 | 17.20 | 13 |
| A (37.5) | 0.1998 | 0.1657 | 82.90 | 0.0341 | 17.10 | 13 |
| Comp 1 (75) | 0.1924 | 0.1447 | 75.20 | 0.0477 | 24.80 | 21 |
| Comp 2 (75) | 0.1966 | 0.1111 | 56.50 | 0.0855 | 43.50 | 41 |

Treatment A is a 2:1 (actives) blend of $C_{17}$ poly(ethylene)-vinylacetate $10^5$ MW copolymer and di-$C_{22}$-alkylfumerate-vinylacetate $3 \times 10^4$ MW 2:1 copolymer.
Comp 1 is a commercially available nonylphenol-formaldehyde ethoxylate.
Comp 2 is a commercially available nonylphenol-formaldehyde ethoxylate.

TABLE VII

Southern refinery
FCC slurry settling study
20 hours settling time at 160° F.
10% methods - solids

| Treatment (ppm) | Wt. in top 10 mL after 20 hours (g) | Avg. Wt. (g) | Weight of sample (g) | Wt. % | Avg. Wt. % |
|---|---|---|---|---|---|
| Blank | 0.019 | 0.019 | 10.71 | 0.177 | 0.177 |
| Blank | 0.025 | 0.025 | 10.71 | 0.233 | 0.233 |
| Comp 1 (75) | 0.012 | — | 10.92 | 0.110 | — |
| Comp 1 (75) | 0.008 | 0.010 | 10.52 | 0.076 | 0.093 |
| Comp 1 (150) | 0.009 | — | 10.24 | 0.088 | — |
| Comp 1 (150) | 0.013 | 0.011 | broken | — | 0.088 |
| Comp 1 (225) | 0.008 | — | 11.01 | 0.073 | — |
| Comp 1 (225) | 0.011 | 0.010 | 10.97 | 0.100 | 0.086 |
| A (37.5) | 0.018 | 0.018 | 11.05 | 0.163 | 0.163 |
| A (75) | 0.019 | 0.019 | 10.66 | 0.178 | 0.178 |
| A (112.5) | 0.019 | 0.019 | 10.84 | 0.175 | 0.175 |

Treatment A is a 2:1 (actives) blend of $C_{17}$ poly(ethylene)-vinylacetate $10^5$ MW copolymer and di-$C_{22}$-alkylfumerate-vinylacetate $3 \times 10^4$ 2:1 copolymer.
Comp 1 is a commercially available nonylphenol-formaldehyde ethoxylate.

These results indicate that a blend of polymers of the present invention provided adequate settling of filterable solids in an FCC slurry. These polymers also proved more effective than the commercially available compounds.

TABLE VIII

Northeast refinery
Slurry settling study
50% filterable solids method

| Treatment (ppm) | Filterable Solids Data: Solids in top 50% (g) | Solids in bot 50% (g) | % Settled (B − T)/(B + T) | % Solids in top 50% | Ash Data: Ash in top 50% (g) | Wt. % Ash in top 50% |
|---|---|---|---|---|---|---|
| Blank | 0.0124 | 0.2658 | 91 | 4.46 | 0.0090 | 0.018 |
| Blank | 0.0051 | 0.2483 | 96 | 2.00 | 0.0026 | 0.005 |
| A (37.5) | 0.0036 | 0.2431 | 97 | 1.46 | 0.0024 | 0.005 |
| A (15.0) | 0.0018 | 0.2421 | 99 | 0.74 | 0.0003 | 0.006 |

*Sample or procedure error suspected.
Treatment A is a 2:1 (actives) blend of $C_{17}$ poly(ethylene)-vinylacetate $10^5$ MW copolymer and di-$C_{22}$-alkylfumerate-vinylacetate $3 \times 10^4$ 2:1 copolymer.

These results indicate that even low dosages (15 ppm) of a blend of the polymers of the present invention provided adequate settling in a different type slurry. As seen in the testing results of Tables I–VIII, the polymers of the present invention provided good settling in a variety of slurry types, particularly in FCC slurries.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what I claim is:

1. A method for accelerating the settling of finely divided solids in hydrocarbon fluids comprising adding to said hydrocarbons an effective settling amount of a hetero-atom punctuated $C_{10}$ to $C_{30}$ alkyl or alkenyl polymer having a molecular weight of from $10^3$ to $10^6$ wherein said alkyl or alkenyl groups are separated by smaller hetero-atom groups.

2. The method as claimed in claim 1 wherein said polymer is an ethylene-vinylacetate copolymer wherein said alkenyl groups are blocks of polyethylene of at least 5 units long and said vinylacetate groups are not in blocks.

3. The method as claimed in claim 1 wherein said polymer is a dialkylfumerate-vinylacetate copolymer.

4. The method as claimed in claim 1 wherein said polymer is an alkylphenol-formaldehyde resin.

5. The method as claimed in claim 1 wherein said polymer is a blend of hetero-atom punctuated fatty polymers.

6. The method as claimed in claim 5 wherein said blend of polymers is a blend of $C_{17}$ poly(ethylene)-vinylacetate $10^5$ MW copolymer and di-$C_{22}$-alkylfumerate-vinylacetate 2:1, $3\times10^4$ MW copolymer.

7. The method as claimed in claim 1 wherein said hydrocarbon is a fluid catalytic cracker slurry.

8. The method as claimed in claim 1 wherein said finely divided solids are fluid catalytic cracker catalyst fines.

9. The method as claimed in claim 1 wherein said hydrocarbon is selected from the group consisting of crude oils, bottom streams, vacuum bottoms, and heavy ends.

10. The method as claimed in claim 1 wherein said polymer is added to said hydrocarbon in a range from about 10 parts per million to about 1000 parts per million parts hydrocarbon.

* * * * *